US012345116B2

(12) United States Patent
Fripp et al.

(10) Patent No.: US 12,345,116 B2
(45) Date of Patent: Jul. 1, 2025

(54) EXPANDABLE METAL AS BACKUP FOR ELASTOMERIC ELEMENTS

(71) Applicant: Halliburton Energy Services, Inc., Houston, TX (US)

(72) Inventors: Michael Linley Fripp, Carrollton, TX (US); Stephen Michael Greci, Little Elm, TX (US); Christopher Michael Pelto, Garland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/228,291

(22) Filed: Apr. 12, 2021

(65) Prior Publication Data

US 2022/0325600 A1 Oct. 13, 2022

(51) Int. Cl.
*E21B 33/12* (2006.01)
*E21B 33/13* (2006.01)

(52) U.S. Cl.
CPC ..... *E21B 33/1208* (2013.01); *E21B 33/1216* (2013.01); *E21B 33/13* (2013.01)

(58) Field of Classification Search
CPC ..... E21B 33/1216; E21B 33/1208
See application file for complete search history.

(56) References Cited

U.S. PATENT DOCUMENTS

| | | | |
|---|---|---|---|
| 1,525,740 | A | 2/1925 | Howard |
| 2,075,912 | A | 4/1937 | Roye |
| 2,590,931 | A | 4/1952 | Cabaniss |
| 2,743,781 | A | 5/1956 | Lane |

(Continued)

FOREIGN PATENT DOCUMENTS

| | | | |
|---|---|---|---|
| CA | 2820742 | A1 | 9/2013 |
| CN | 203308412 | U | 11/2013 |

(Continued)

OTHER PUBLICATIONS

Fripp, et al. "Novel Expanding Metal Alloy for Non-Elastomeric Sealing and Anchoring." Paper presented at the SPE Annual Technical Conference and Exhibition, Houston, Texas, USA, Oct. 2022. doi: https://doi.org/10.2118/210273-MS (Year: 2022).*

*Primary Examiner* — Theodore N Yao
(74) *Attorney, Agent, or Firm* — Scott Richardson; Parker Justiss, P.C.

(57) ABSTRACT

Provided is a sealing tool, a method for sealing an annulus within a wellbore, and a well system. The sealing tool, in at least one aspect, includes a sealing assembly positioned about a mandrel. In at least one aspect, the sealing assembly includes one or more elastomeric sealing elements having a width ($W_{SE}$), the one or more elastomeric sealing elements operable to move between a radially relaxed state and a radially expanded state. In at least this aspect, the sealing assembly includes a pair of expandable metal features straddling the one or more elastomeric sealing elements, each of the pair of expandable metal features comprising a metal configured to expand in response to hydrolysis and having a width ($W_{EM}$), and further wherein the width (WSE) is at least three times the width ($W_{EM}$).

20 Claims, 7 Drawing Sheets

(56) References Cited

U.S. PATENT DOCUMENTS 2,865,454 A 12/1958 Richards
3,206,536 A 9/1965 Goodloe
3,371,716 A 3/1968 Current
3,616,354 A 10/1971 Russell
3,706,125 A 12/1972 Hopkins
4,270,608 A 6/1981 Hendrickson
4,424,859 A 1/1984 Sims
4,424,861 A 1/1984 Carter
4,442,908 A 4/1984 Steenbock
4,446,932 A 5/1984 Hipp
4,457,379 A 7/1984 McStravick
4,527,815 A 7/1985 Frick
4,977,636 A 12/1990 King
4,979,585 A 12/1990 Chesnutt
5,139,274 A 8/1992 Oseman
5,220,959 A 6/1993 Vance
5,424,139 A 6/1995 Shuler
5,492,173 A 2/1996 Kilgore
5,517,981 A 5/1996 Taub et al.
5,662,341 A 9/1997 Ezell et al.
5,667,015 A 9/1997 Harestad
5,803,173 A 9/1998 Fraser et al.
6,089,320 A 7/2000 LaGrange
6,106,024 A 8/2000 Herman et al.
6,840,325 B2 1/2005 Stephenson
6,907,930 B2 6/2005 Cavender
6,942,039 B2 9/2005 Tinker
7,040,404 B2 5/2006 Brothers et al.
7,104,322 B2 9/2006 Whanger et al.
7,152,687 B2 12/2006 Gano
7,322,408 B2 1/2008 Howlett
7,347,274 B2 3/2008 Patel
7,350,590 B2 4/2008 Hosie et al.
7,402,277 B2 7/2008 Ayer
7,578,043 B2 8/2009 Simpson et al.
7,578,347 B2 8/2009 Bosma et al.
7,673,688 B1 3/2010 Jones
7,677,303 B2 3/2010 Coronado
7,696,275 B2 4/2010 Slay et al.
7,963,321 B2 6/2011 Kutac
7,996,945 B2 8/2011 Nosker
8,042,841 B2 10/2011 Viegener
8,109,339 B2 2/2012 Xu
8,225,861 B2 7/2012 Foster et al.
8,266,751 B2 9/2012 He
8,430,176 B2 4/2013 Xu
8,453,736 B2 6/2013 Constantine
8,459,367 B2 6/2013 Nutley et al.
8,469,084 B2 6/2013 Clark et al.
8,490,707 B2 7/2013 Robisson
8,579,024 B2 11/2013 Mailand et al.
8,684,096 B2 4/2014 Harris
8,794,330 B2 8/2014 Stout
8,807,209 B2 8/2014 King
8,875,800 B2 11/2014 Wood et al.
8,894,070 B2 11/2014 Bhat et al.
8,993,491 B2 3/2015 James
9,004,173 B2 4/2015 Richard
9,217,311 B2 12/2015 Slup
9,249,904 B2 2/2016 Duquette
9,279,295 B2 3/2016 Williamson et al.
9,347,272 B2 5/2016 Hewson et al.
9,353,606 B2 5/2016 Bruce et al.
9,393,601 B2 7/2016 Ranck
9,404,030 B2 8/2016 Mazyar
9,534,460 B2 1/2017 Watson et al.
9,611,715 B1 4/2017 Smith
9,644,459 B2 5/2017 Themig
9,708,880 B2 7/2017 Solhaug
9,725,979 B2 8/2017 Mazyar et al.
9,732,578 B2 8/2017 McRobb
9,745,451 B2 8/2017 Zhao et al.
9,765,595 B2 9/2017 Themig et al.
9,771,510 B2 9/2017 James et al.
9,945,190 B2 4/2018 Crowley
9,976,380 B2 5/2018 Davis et al.
9,976,381 B2 5/2018 Martin et al.
10,030,467 B2 7/2018 Al-Gouhi
10,060,225 B2 8/2018 Wolf
10,119,011 B2 11/2018 Zhao et al.
10,179,873 B1 1/2019 Meng
10,316,601 B2 6/2019 Walton et al.
10,337,298 B2 7/2019 Braddick
10,344,570 B2 7/2019 Steele
10,352,109 B2 7/2019 Sanchez
10,364,636 B2 7/2019 Davis
10,472,933 B2 11/2019 Steele
10,533,392 B2 1/2020 Walton et al.
10,718,183 B2 7/2020 Bruce et al.
10,758,974 B2 9/2020 Sherman
10,794,152 B2 10/2020 Lang et al.
10,961,804 B1 3/2021 Fripp
11,359,448 B2 6/2022 Fripp
11,365,611 B2 6/2022 Gibb
11,428,066 B2 8/2022 Andersen
11,512,552 B2 11/2022 Fripp
2002/0088616 A1 7/2002 Swor et al.
2003/0132001 A1 7/2003 Wilson
2003/0150614 A1 8/2003 Brown et al.
2003/0164236 A1 9/2003 Thornton
2003/0164237 A1 9/2003 Butterfield, Jr.
2003/0205377 A1 11/2003 Streater
2004/0194970 A1 10/2004 Eatwell
2005/0051333 A1 3/2005 Weber
2005/0061369 A1 3/2005 De Almeida
2005/0072576 A1 4/2005 Henriksen
2005/0093250 A1 5/2005 Santi et al.
2005/0199401 A1 9/2005 Patel et al.
2006/0144591 A1 7/2006 Gonzalez
2006/0272806 A1 12/2006 Wilkie et al.
2007/0089875 A1 4/2007 Steele et al.
2007/0089910 A1 4/2007 Hewson et al.
2007/0095532 A1 5/2007 Head
2007/0137826 A1 6/2007 Bosma et al.
2007/0144734 A1 6/2007 Xu et al.
2007/0151724 A1 7/2007 Ohmer et al.
2007/0163781 A1 7/2007 Walker
2007/0221387 A1 9/2007 Levy
2007/0246213 A1 10/2007 Hailey
2007/0267824 A1 11/2007 Baugh et al.
2007/0277979 A1 12/2007 Todd et al.
2008/0047708 A1 2/2008 Spencer
2008/0135249 A1 6/2008 Fripp
2008/0149351 A1 6/2008 Marya
2008/0290603 A1 11/2008 Laflin
2009/0014173 A1 1/2009 Macleod
2009/0084555 A1 4/2009 Lee
2009/0102133 A1 4/2009 Ruddock
2009/0139707 A1* 6/2009 Berzin ..... E21B 33/1216 29/428
2009/0159278 A1 6/2009 Corre
2009/0200028 A1 8/2009 Dewar
2009/0250227 A1 10/2009 Brown et al.
2009/0250228 A1 10/2009 Loretz
2009/0260801 A1* 10/2009 Nutley ..... E21B 33/1208 29/428
2009/0272546 A1 11/2009 Nutley et al.
2009/0321087 A1 12/2009 Victorov
2010/0072711 A1 3/2010 Doane
2010/0078173 A1 4/2010 Buytaert et al.
2010/0096143 A1 4/2010 Angman
2010/0108148 A1 5/2010 Chen
2010/0122819 A1 5/2010 Wildman
2010/0139930 A1 6/2010 Patel
2010/0155083 A1 6/2010 Lynde et al.
2010/0181080 A1 7/2010 Levy
2010/0212891 A1* 8/2010 Stewart ..... E21B 23/00 166/250.12
2010/0225107 A1 9/2010 Tverlid
2010/0257913 A1 10/2010 Storm, Jr. et al.
2010/0307737 A1 12/2010 Mellemstrand
2011/0061876 A1 3/2011 Johnson et al.
2011/0098202 A1* 4/2011 James ..... C09K 8/5086 507/221

(56) References Cited

U.S. PATENT DOCUMENTS

2011/0147014 A1 6/2011 Chen et al.
2012/0018143 A1 1/2012 Lembcke
2012/0048531 A1 3/2012 Marzouk
2012/0048561 A1 3/2012 Holderman
2012/0048623 A1 3/2012 Lafuente et al.
2012/0049462 A1 3/2012 Pitman
2012/0168147 A1 7/2012 Bowersock
2012/0175134 A1 7/2012 Robisson
2012/0273236 A1 11/2012 Gandikota et al.
2013/0048289 A1 2/2013 Mazyar et al.
2013/0056207 A1 3/2013 Wood et al.
2013/0081815 A1 4/2013 Mazyar et al.
2013/0152824 A1 6/2013 Crews
2013/0153236 A1 6/2013 Bishop
2013/0161006 A1 6/2013 Robisson et al.
2013/0186615 A1 7/2013 Hallunbaek et al.
2013/0192853 A1 8/2013 Themig
2013/0292117 A1 11/2013 Robisson
2014/0026335 A1 1/2014 Smith
2014/0034308 A1 2/2014 Holderman
2014/0051612 A1 2/2014 Mazyar
2014/0262352 A1 9/2014 Lembcke
2015/0021049 A1 1/2015 Davis et al.
2015/0060088 A1* 3/2015 Goodman ..... E21B 33/1285 166/387
2015/0075768 A1 3/2015 Wright et al.
2015/0101813 A1 4/2015 Zhao
2015/0113913 A1 4/2015 Kim
2015/0184486 A1 7/2015 Epstein
2015/0204158 A1* 7/2015 Frisby ..... E21B 33/1208 166/387
2015/0233190 A1 8/2015 Wolf et al.
2015/0275587 A1 10/2015 Wolf et al.
2015/0337615 A1 11/2015 Epstein et al.
2015/0345248 A1 12/2015 Carragher
2015/0368990 A1 12/2015 Jewett
2015/0369003 A1 12/2015 Hajjari et al.
2016/0024896 A1 1/2016 Johnson et al.
2016/0024902 A1 1/2016 Richter
2016/0137912 A1 5/2016 Sherman et al.
2016/0138359 A1 5/2016 Zhao
2016/0145488 A1 5/2016 Aines et al.
2016/0145968 A1 5/2016 Marya
2016/0177668 A1 6/2016 Watson et al.
2016/0194936 A1 7/2016 Allen
2016/0208569 A1 7/2016 Anderson et al.
2016/0230495 A1 8/2016 Mazyar et al.
2016/0273312 A1 9/2016 Steele et al.
2016/0319633 A1 11/2016 Cooper et al.
2016/0326830 A1 11/2016 Hallundbaek
2016/0326849 A1 11/2016 Bruce
2016/0333187 A1 11/2016 Bauer et al.
2016/0369586 A1* 12/2016 Morehead ..... E21B 33/128
2017/0015824 A1 1/2017 Gozalo
2017/0022778 A1 1/2017 Fripp et al.
2017/0107419 A1 4/2017 Roy et al.
2017/0107794 A1 4/2017 Steele
2017/0113275 A1 4/2017 Roy et al.
2017/0159401 A1 6/2017 Saltel et al.
2017/0175487 A1 6/2017 Marcin et al.
2017/0175488 A1 6/2017 Lisowski
2017/0191342 A1 7/2017 Turley
2017/0191343 A1 7/2017 Solhaug
2017/0198191 A1 7/2017 Potapenko
2017/0234103 A1 8/2017 Frazier
2017/0306714 A1 10/2017 Haugland
2017/0314372 A1 11/2017 Tolman
2017/0350237 A1 12/2017 Giem et al.
2017/0356266 A1 12/2017 Arackakudiyil
2018/0023362 A1 1/2018 Makowiecki et al.
2018/0023366 A1 1/2018 Deng et al.
2018/0038193 A1 2/2018 Walton
2018/0080304 A1 3/2018 Cortez et al.
2018/0081468 A1 3/2018 Bruce et al.
2018/0086894 A1 3/2018 Roy
2018/0087350 A1 3/2018 Sherman
2018/0094508 A1 4/2018 Smith et al.
2018/0100367 A1 4/2018 Perez
2018/0128072 A1 5/2018 Larsen
2018/0128082 A1 5/2018 Hollan et al.
2018/0209234 A1 7/2018 Manera
2018/0223624 A1 8/2018 Fripp
2018/0298708 A1 10/2018 Schmidt et al.
2018/0334882 A1 11/2018 Brandsdal
2018/0347288 A1 12/2018 Fripp
2018/0363409 A1 12/2018 Frazier
2019/0016951 A1 1/2019 Sherman et al.
2019/0032435 A1 1/2019 Kochanek et al.
2019/0039126 A1 2/2019 Sherman
2019/0078414 A1 3/2019 Frazier
2019/0128092 A1 5/2019 Mueller et al.
2019/0136666 A1 5/2019 Kent
2019/0178054 A1 6/2019 Bruce
2019/0186228 A1 6/2019 Beckett et al.
2019/0225861 A1 7/2019 Reddy
2019/0249510 A1 8/2019 Deng et al.
2019/0316025 A1 10/2019 Sherman
2019/0383115 A1 12/2019 Lees
2020/0032574 A1 1/2020 Fripp et al.
2020/0056435 A1 2/2020 Sherman
2020/0072019 A1 3/2020 Onti et al.
2020/0080401 A1* 3/2020 Sherman ..... E21B 43/086
2020/0080402 A1 3/2020 Lang et al.
2020/0240235 A1 7/2020 Fripp et al.
2020/0308945 A1 10/2020 Surjaatmadja et al.
2020/0325749 A1 10/2020 Fripp et al.
2020/0362224 A1 11/2020 Wellhoefer
2020/0370391 A1 11/2020 Fripp et al.
2021/0017835 A1 1/2021 Pelto et al.
2021/0040810 A1 2/2021 Evers
2021/0123310 A1 4/2021 Fripp et al.
2021/0123319 A1 4/2021 Greci
2021/0172286 A1 6/2021 Barlow
2021/0187604 A1 6/2021 Sherman et al.
2021/0270093 A1 9/2021 Fripp
2021/0270103 A1 9/2021 Greci et al.
2021/0332673 A1 10/2021 Fripp
2021/0363849 A1 11/2021 Al Yahya
2022/0106847 A1 4/2022 Dahl
2022/0186575 A1 6/2022 Fripp
2022/0205336 A1 6/2022 Asthana
2022/0372837 A1 11/2022 Holderman et al.

FOREIGN PATENT DOCUMENTS

CN 205422632 U 8/2016
CN 107148444 A 9/2017
CN 108194756 A 6/2018
CN 107148444 B 1/2019
CN 108194756 B 8/2020
EP 15726 A1 9/1980
EP 869257 A2 10/1998
EP 940558 A1 9/1999
EP 0940558 B1 1/2005
EP 1757770 A1 2/2007
EP 1910728 A1 4/2008
EP 1910728 B1 9/2009
EP 2447466 A2 5/2012
EP 2501890 A2 9/2012
EP 2501890 B 7/2014
EP 2447466 A3 3/2017
EP 3144018 A1 3/2017
EP 3144018 A4 5/2017
EP 3196402 A1 7/2017
EP 3144018 B1 9/2018
EP 2447466 B1 10/2018
EP 3167148 B1 12/2018
GB 2444060 A 5/2008
GB 2444060 B 12/2008
JP 2003090037 A 3/2003
JP 2003293354 A 10/2003
JP 2004169303 A 6/2004
JP 2015175449 A 10/2015
KR 20020014619 A 2/2002

(56) References Cited

FOREIGN PATENT DOCUMENTS

| | | | |
|---|---|---|---|
| KR | 20080096576 | A | 10/2008 |
| WO | 02/02900 | A2 | 1/2002 |
| WO | 02/02900 | A3 | 5/2002 |
| WO | 02/02900 | A8 | 12/2003 |
| WO | 2005/022012 | A1 | 3/2005 |
| WO | 2006/045794 | A1 | 5/2006 |
| WO | 2007/047089 | A1 | 4/2007 |
| WO | 2012/094322 | A2 | 7/2012 |
| WO | 2012/125660 | A2 | 9/2012 |
| WO | 2012/094322 | A3 | 10/2012 |
| WO | 2012/125660 | A3 | 2/2013 |
| WO | 2014/028149 | A1 | 2/2014 |
| WO | 2014/182301 | A1 | 11/2014 |
| WO | 2014/193042 | A1 | 12/2014 |
| WO | 2015/057338 | A1 | 4/2015 |
| WO | 2015/069886 | A2 | 5/2015 |
| WO | 2015/069886 | A3 | 9/2015 |
| WO | 2015/183277 | A1 | 12/2015 |
| WO | 2016/000068 | A1 | 1/2016 |
| WO | 2016/171666 | A1 | 10/2016 |
| WO | 2017/100417 | A1 | 6/2017 |
| WO | 2018/055382 | A1 | 3/2018 |
| WO | 2019/094044 | A1 | 5/2019 |
| WO | 2019/122857 | A1 | 6/2019 |
| WO | 2019/147285 | A1 | 8/2019 |
| WO | 2019/151870 | A1 | 8/2019 |
| WO | 2019/164499 | A1 | 8/2019 |
| WO | 2020/005252 | A1 | 1/2020 |
| WO | 2020/141203 | A1 | 7/2020 |
| WO | 2019/164499 | A8 | 8/2020 |
| WO | 2020/167288 | A1 | 8/2020 |
| WO | 2020/204940 | A1 | 10/2020 |
| WO | 2021011013 | A1 | 1/2021 |
| WO | 2021/034325 | A1 | 2/2021 |
| WO | 2021/086317 | A1 | 5/2021 |
| WO | 2021/096519 | A1 | 5/2021 |
| WO | 2021/126279 | A1 | 6/2021 |

* cited by examiner

EXPANDABLE METAL AS BACKUP FOR ELASTOMERIC ELEMENTS

BACKGROUND

A typical sealing assembly (e.g., packer, bridge plug, etc.) generally has one or more seal elements or "rubbers" that are employed to provide a fluid-tight seal radially between a mandrel of the sealing assembly and casing into which the sealing assembly is disposed. Such a sealing assembly is commonly conveyed into the casing in a subterranean wellbore suspended from tubing extending to the earth's surface.

To prevent damage to the seal elements while the sealing assembly is being conveyed into the wellbore, the seal elements are carried on the mandrel in a relaxed or uncompressed state in which they are radially inwardly spaced apart from the casing. When the sealing assembly is set, the seal elements radially expand (e.g., both radially inward and radially outward), thereby sealing against the mandrel and the casing. In certain embodiments, the seal elements are axially compressed between element retainers straddling the seal elements on the seal assembly, which in turn radially expand the seal elements. In other embodiments, one or more swellable seal elements are axially positioned between the element retainers, the swellable seal elements configured to radially expand when subjected to one or more different activation fluids.

The seal assembly often includes a number of slips which grip the casing and prevent movement of the seal assembly axially within the casing after the seal assembly has been set. Thus, if weight or fluid pressure is applied to the seal assembly, the slips resist the axial forces on the seal assembly produced thereby, and prevent axial displacement of the seal assembly relative to the casing.

If, however, fluid pressure is applied to an annular space radially between the sealing assembly and the casing, and above or below the seal elements, the seal elements may be displaced axially into the annular space between the seal assembly and the casing as a result of the differential pressure across the seal elements. Additionally, the seal elements may be displaced into voids, spaces, gaps, etc. on the packer, such as into a radial gap between the element retainer and the mandrel. Such displacements of the seal elements may be caused by fluid pressure acting on the seal elements, or may be caused by axial compression of the seal elements when the seal assembly is set.

It is generally undesirable for the seal elements to displace into the above-described gaps, voids, etc. for a number of reasons. For example, if the seal elements displace into the radial gap between the seal assembly and the casing, and it is later desired to retrieve the seal assembly from the well, the presence of the seal element material in the radial gap may make it difficult to axially displace the seal assembly in the casing. More importantly, displacement of the seal element after the seal assembly has been set usually compromises the ability of the seal elements to effectively seal between the casing and the mandrel.

BRIEF DESCRIPTION

Reference is now made to the following descriptions taken in conjunction with the accompanying drawings, in which:

FIGS. 4A through 4C illustrate various different deployment states for a sealing tool designed, manufactured and operated according to an alternative embodiment of the disclosure;

DETAILED DESCRIPTION

Figure 1:
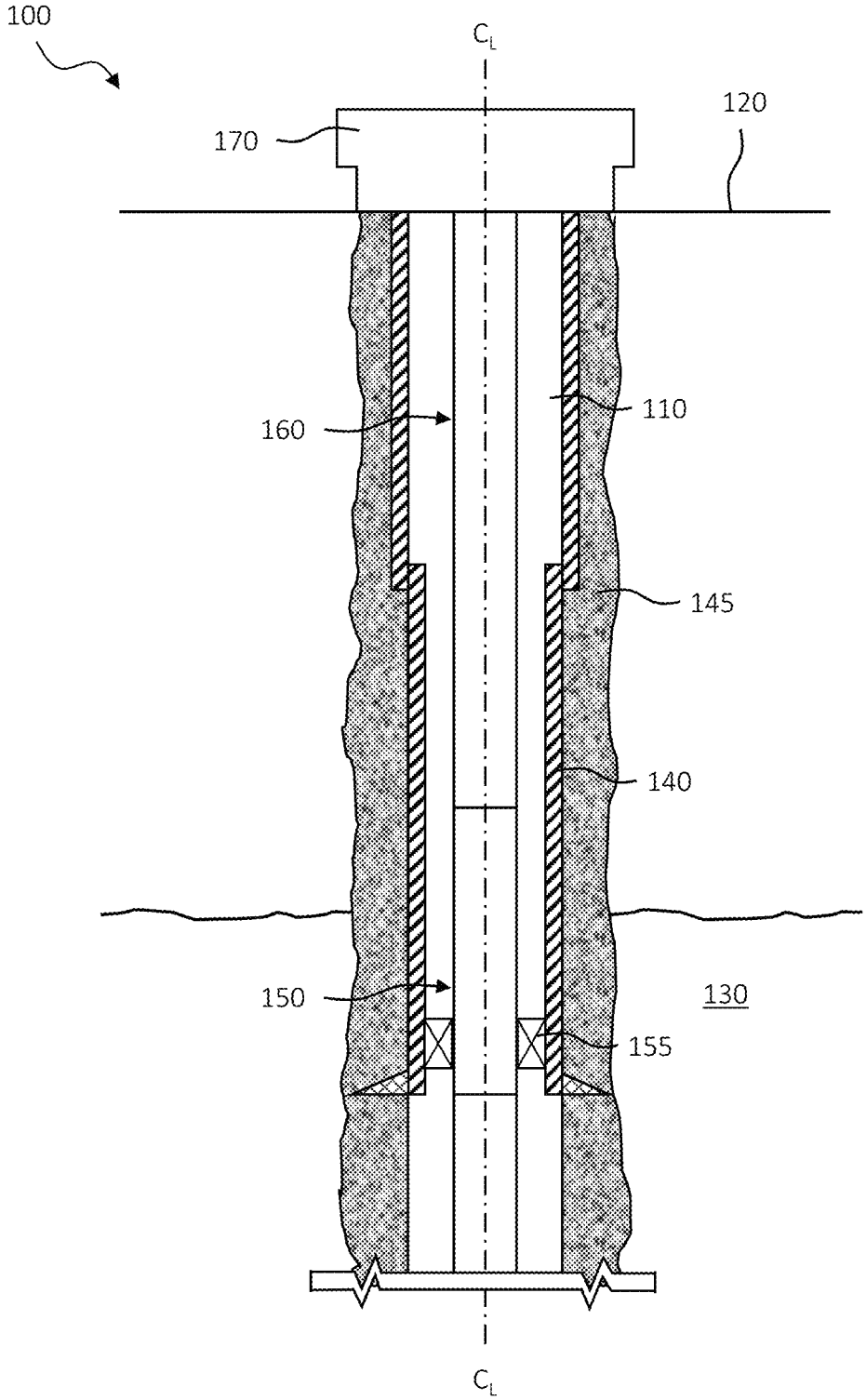
FIG. 1 illustrates a well system designed, manufactured, and operated according to one or more embodiments of the disclosure, the well system including a sealing tool including a sealing assembly designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure describes a seal assembly employing expandable/expanded metal as a backup to an elastomer in a compression set packer or in a swell rubber packer. The expandable/expanded metal may embody many different locations, sizes and shapes within the seal assembly while remaining within the scope of the present disclosure. In at least one embodiment, the expandable/expanded metal reacts with fluids within the wellbore to create a non-elastomeric backup that has minimal extrusion gap. Accordingly, the use of the expandable/expanded metal within the seal assembly minimizes the likelihood of extruding a seal.

FIG. 1 illustrates a well system 100 designed, manufactured, and operated according to one or more embodiments of the disclosure, the well system 100 including a sealing tool 150 including a sealing assembly 155 designed, manufactured and operated according to one or more embodiments of the disclosure. The well system 100 includes a wellbore 110 that extends from a terranean surface 120 into one or more subterranean zones 130. When completed, the well system 100 produces reservoir fluids and/or injects fluids into the subterranean zones 130. As those skilled in the art appreciate, the wellbore 120 may be fully cased, partially cased, or an open hole wellbore. In the illustrated embodiment of FIG. 1, the wellbore 110 is at least partially cased, and thus is lined with casing or liner 140. The casing or liner 140, as is depicted, may be held into place by cement 145.

An example well sealing tool 150 is coupled with a tubing string 160 that extends from a wellhead 170 into the wellbore 110. The tubing string 160 can be a coiled tubing and/or a string of joint tubing coupled end to end. For example, the tubing string 160 may be a working string, an injection string, and/or a production string. The sealing tool 150 can include a bridge plug, frac plug, packer and/or other sealing tool, having a seal assembly 155 for sealing against the wellbore 110 wall (e.g., the casing 140, a liner and/or the bare rock in an open hole context). The seal assembly 155 can isolate an interval of the wellbore 110 above the seal assembly 155 from an interval of the wellbore 110 below the seal assembly 155, for example, so that a pressure differential can exist between the intervals.

In accordance with the disclosure, the seal assembly 155 may include expandable and/or expandable metal therein. The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or mandrel diameter due to variations in temperature and/or pressure. Nevertheless, other embodiments may exist wherein no residual unreacted metal exists in the expanded metal.

The expandable metal, in some embodiments, may be described as expanding to a cement like material. In other words, the expandable metal goes from metal to micron-scale particles and then these particles expand and lock together to, in essence, assist in preventing extrusion within the sealing assembly. The reaction may, in certain embodiments, occur in less than 2 days in a reactive fluid and in downhole temperatures. Nevertheless, the time of reaction may vary depending on the reactive fluid, the expandable metal used, and the downhole temperature.

In some embodiments, the reactive fluid may be a brine solution such as may be produced during well completion activities, and in other embodiments, the reactive fluid may be one of the additional solutions discussed herein. The expandable metal is electrically conductive in certain embodiments. The expandable metal may be machined to any specific size/shape, extruded, formed, cast or other conventional ways to get the desired shape of a metal, as will be discussed in greater detail below. The expandable metal, in certain embodiments has a yield strength greater than about 8,000 psi, e.g., 8,000 psi+/−50%.

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reaction uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg, CA, etc.) work well for the expandable metal, but transition metals (Al, etc.) also work well for the expandable metal. In one embodiment, the metal hydroxide is dehydrated by the swell pressure to form a metal oxide.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C— Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof.

Optionally, non-expanding components may be added to the starting metallic materials. For example, ceramic, elastomer, plastic, epoxy, glass, or non-reacting metal components can be embedded in the expandable metal or coated on the surface of the expandable metal. Alternatively, the starting expandable metal may be the metal oxide. For example, calcium oxide (CaO) with water will produce calcium hydroxide in an energetic reaction. Due to the higher density of calcium oxide, this can have a 260% volumetric expansion (e.g., converting 1 mole of CaO may cause the volume to increase from 9.5 cc to 34.4 cc). In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for fully expanding. For example, the expandable metal may be formed into a single long member, multiple short members, rings, among others. In another embodiment, the expandable metal may be formed into a long wire of expandable metal, that can be in turn be wound around a downhole feature such as a mandrel. In certain other embodiments, the expandable metal is a collection of individual separate chunks of the metal held together with a binding agent. In yet other embodiments, the expandable metal is a collection of individual separate chunks of the metal that are not held together with a binding agent. Additionally, a delay coating may be applied to one or more portions of the expandable metal to delay the expanding reactions.

Figure 2A:
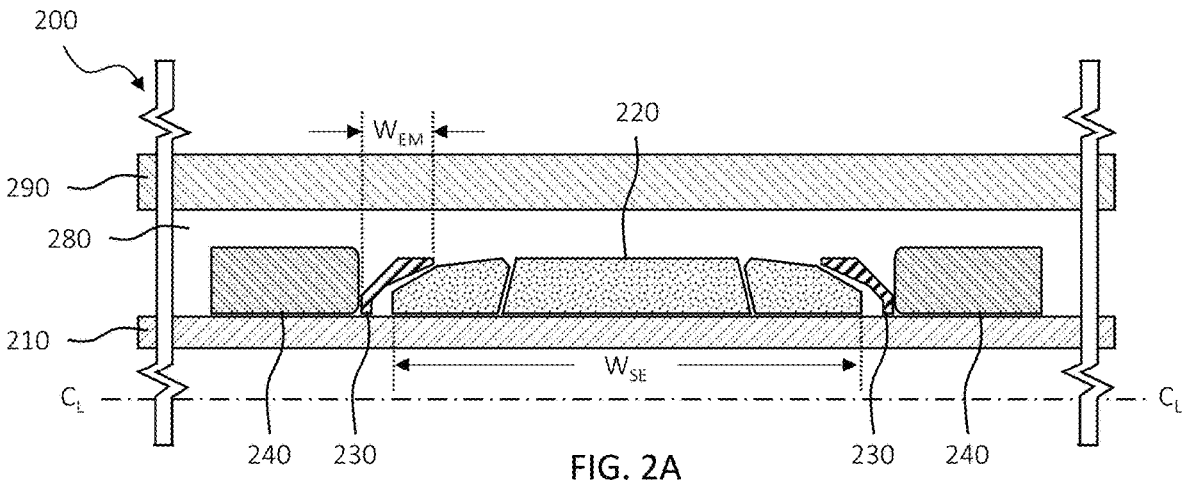
FIGS. 2A through 2C illustrate various different deployment states for a sealing tool designed, manufactured and operated according to one aspect of the disclosure.
Figure 2B:
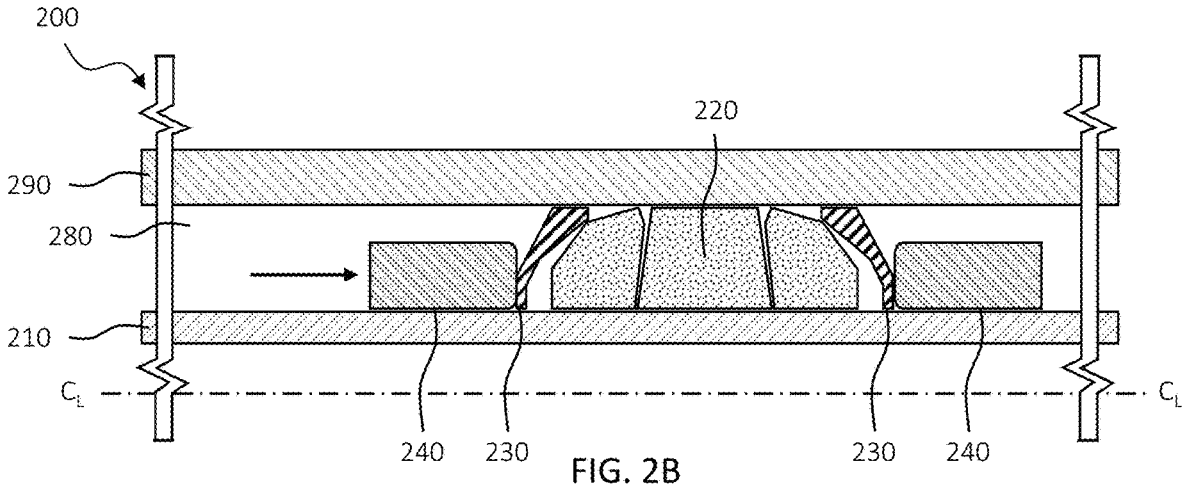
Figure 2C:
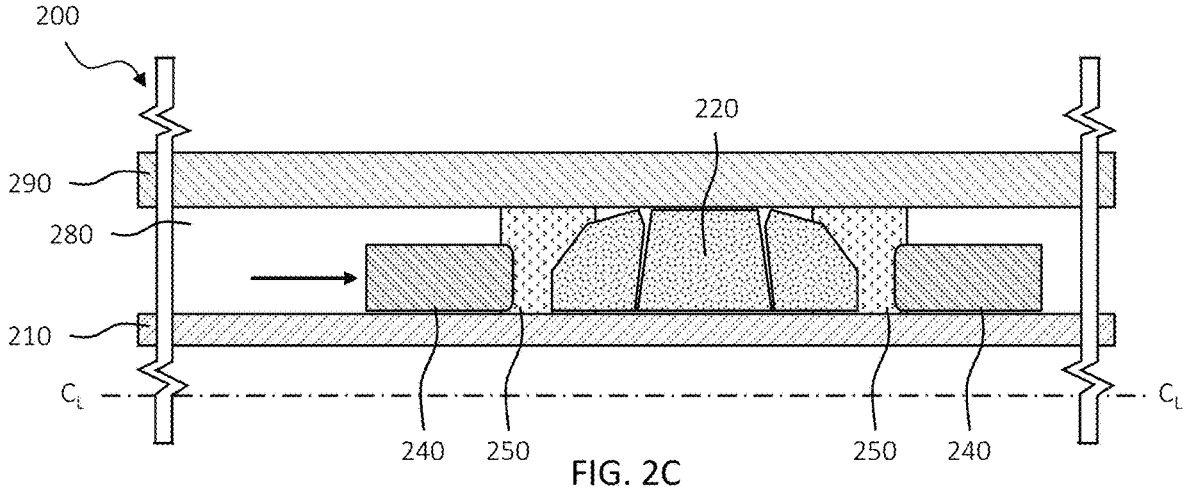

Turning to FIGS. 2A through 2C, depicted are various different deployment states for a sealing tool 200 designed, manufactured and operated according to one aspect of the disclosure. FIG. 2A illustrates the sealing tool 200 in a run-in-hole state, and thus its elastomeric sealing element is in the radially relaxed state and its expandable metal features pre-expansion. In contrast, FIG. 2B illustrates the sealing tool 200 with its elastomeric element in the radially expanded state, but its expandable metal features remain pre-expansion. In contrast, FIG. 2C illustrates the sealing tool 200 with its elastomeric element in the radially expanded state and including expanded metal features (e.g., the expandable metal features post-expansion). As disclosed above, the expandable metal may be subjected to a suitable reactive fluid within the wellbore, thereby forming the expanded metal features.

The sealing tool 200, in the illustrated embodiment of FIGS. 2A through 2C, includes a mandrel 210. The mandrel 210, in the illustrated embodiment, is centered about a centerline ($C_L$). The sealing tool 200, in at least the embodiment of FIGS. 2A through 2C, additionally includes a bore 290 positioned around the mandrel 210. The bore 290, in at least one embodiment, is a wellbore. The bore 290, in at least one other embodiment, is a tubular positioned within a wellbore, such as a casing, production tubing, etc. In accordance with one aspect of the disclosure, the mandrel 210 and the bore 290 form an annulus 280.

In accordance with one embodiment of the disclosure, the sealing tool 200 includes one or more elastomeric sealing elements 220 positioned about the mandrel. The one or more elastomeric sealing elements 220 have a pre-expansion width ($W_{SE}$), and are operable to move between a radially relaxed state, such as that shown in FIG. 2A, and a radially expanded state, such as that shown in FIGS. 2B and 2C. While three elastomeric sealing elements 220 are illustrated in FIGS. 2A through 2C, other embodiments exist wherein only a single elastomeric sealing element is employed. In the embodiment of FIGS. 2A through 2C, the one or more elastomeric sealing elements 220 comprise a non-swellable elastomer. Nevertheless, other embodiments exist wherein the one or more elastomeric sealing elements 220 comprise a swellable elastomer.

In the illustrated embodiment of FIGS. 2A through 2C, a pair of metal backup shoes 230 straddle the one or more elastomeric sealing elements 220, and a pair of end rings 240 straddle the pair of metal backup shoes 230. Those skilled in the art understand and appreciate the desire and/or need for the pair of metal backup shoes 230, including preventing extrusion of the one or more elastomeric sealing elements 220. Similarly, those skilled in the art appreciate the desire and/or need for the pair of end rings 240. For example, in the illustrated embodiment of FIGS. 2A through 2C, the pair of end rings 240 are configured to axially slide relative to one another to move the one or more elastomeric sealing elements 220 between the radially relaxed state of FIG. 2A and the radially expanded state of FIGS. 2B and 2C.

With reference to FIG. 2A, the pair of metal backup shoes 230 are expandable metal backup shoes. For example, in accordance with the embodiment of FIG. 2A, the pair of expandable metal backup shoes 230 comprise a metal configured to expand in response to hydrolysis. The pair of expandable metal backup shoes 230 may comprise any of the expandable metals discussed above. Each of the pair of expandable metal backup shoes 230 may have a variety of different shapes, sizes, etc. and remain within the scope of the disclosure. In accordance with one embodiment of the disclosure, each of the pair of expandable metal backup shoes 230 has a pre-expansion width ($W_{EM}$). Further to one or more embodiments, the pre-expansion width ($W_{SE}$) is at least three times the pre-expansion width ($W_{EM}$).

With reference to FIG. 2B, illustrated is the sealing tool 200 of FIG. 2A after setting the one or more elastomeric sealing elements 220. In the illustrated embodiment of FIG. 2B, the one or more elastomeric sealing elements 220 are set by axially moving the pair of end rings 240 relative to another, and thereby moving the one or more elastomeric sealing elements 220 from the radially relaxed state of FIG. 2A to the radially expanded state of FIG. 2B. In the illustrated embodiment of FIG. 2B, the one or more elastomeric sealing elements 220 engage with the bore 290, thereby sealing the annulus 280. Further to the embodiment of FIG. 2B, the pair of expandable metal backup shoes 230 have been mechanically and/or plastically deformed, in this instance also engaging the bore 290. In at least one embodiment, the mechanical deformation may be achieved by adjusting the shape of the expandable metal backup shoes 230. For example, the pair of expandable metal backup shoes 230 could have a scarf cut, spiral cut, or another shape, that allows the pair of expandable metal backup shoes 230 to expand radially as they are axially compressed.

With reference to FIG. 2C, illustrated is the sealing tool 200 of FIG. 2B after subjecting the pair of expandable metal backup shoes 230 to reactive fluid to form a pair of expanded metal backup shoes 250. As disclosed above, the expanded metal backup shoes 250 may include residual unreacted metal. The reactive fluid may be any of the reactive fluid discussed above. In the illustrated embodiment of FIG. 2C, the pair of expanded metal backup shoes 250 at least partially fill the annulus 280, and thereby act as anti-extrusion features for the one or more elastomeric sealing elements 220. The expanded metal backup shoes 250 may additionally have a sealing affect, and thus act as a secondary seal.

In certain embodiments, the time period for the hydration of the expandable metal backup shoes 230 is different from the time period for setting the one or more elastomeric sealing elements 220. For example, the setting of the one or more elastomeric sealing elements 220 might create an elastomeric seal in an hour or less, whereas the expandable metal backup shoes 230 could take multiple hours to several days for the hydrolysis process to fully expand and form the expanded metal backup shoes 250.

Figure 3A:
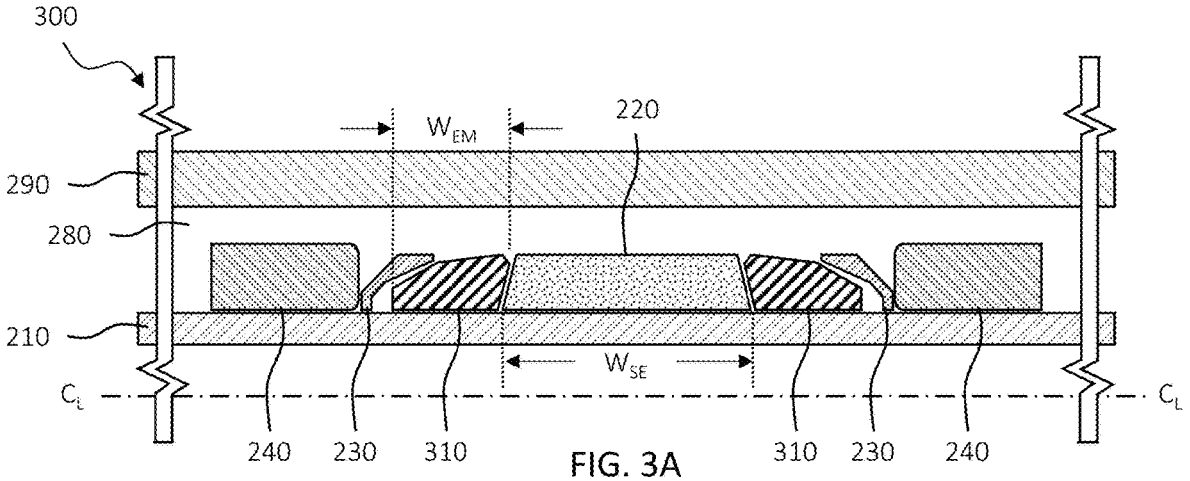
FIGS. 3A through 3C illustrate various different deployment states for a sealing tool designed, manufactured and operated according to an alternative embodiment of the disclosure.
Figure 3B:
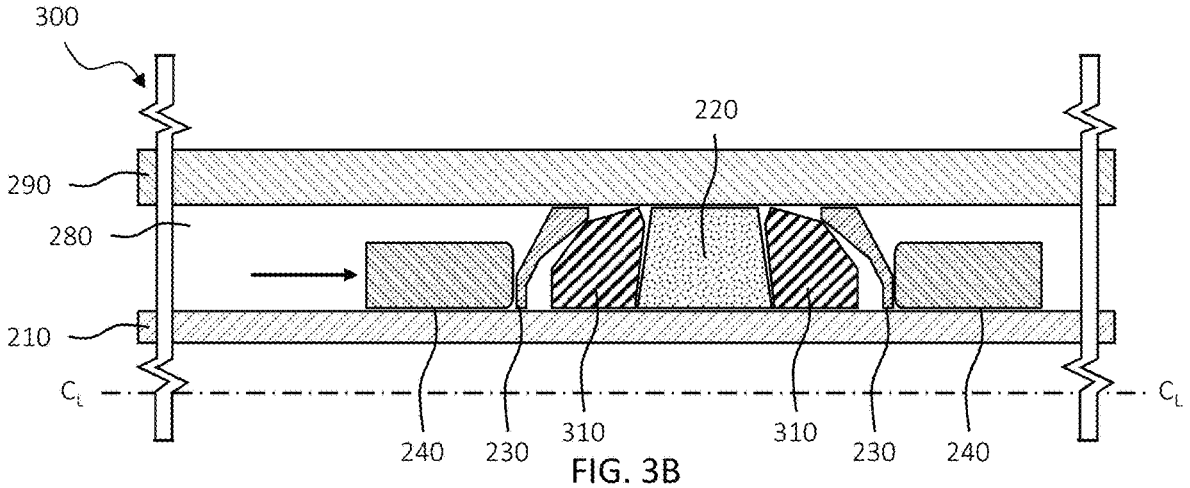
Figure 3C:
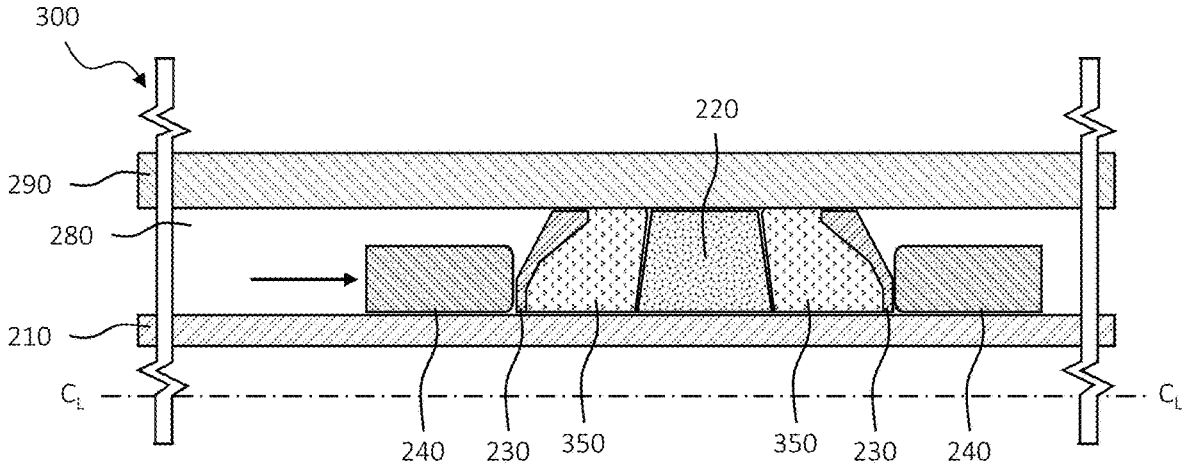

Turning to FIGS. 3A through 3C, depicted are various different deployment states for a sealing assembly 300 designed, manufactured and operated according to an alternative embodiment of the disclosure. FIG. 3A illustrates the sealing tool 300 in a run-in-hole state, and thus its elastomeric sealing element is in the radially relaxed state and its expandable metal features pre-expansion. In contrast, FIG. 3B illustrates the sealing tool 300 with its elastomeric element in the radially expanded state, but its expandable metal features remain pre-expansion. In contrast, FIG. 3C illustrates the sealing tool 300 with its elastomeric element in the radially expanded state and including expanded metal features (e.g., the expandable metal features post-expansion). As disclosed above, the expandable metal may be subjected to a suitable reactive fluid within the wellbore, thereby forming the expanded metal features.

The sealing assembly 300 of FIGS. 3A through 3C is similar in many respects to the sealing assembly 200 of FIGS. 2A through 2C. Accordingly, like reference numbers have been used to illustrate similar, if not identical, features. The sealing assembly 300 differs, for the most part, from the sealing assembly 200, in that the sealing assembly 300 does not employ expandable/expanded metal as its metal backup shoes 230, but includes a separate pair of expandable metal features 310 straddling the one or more elastomeric sealing elements 220, as shown in FIGS. 3A and 3B, and a pair of expanded metal features 350 straddling the one or more elastomeric sealing elements, as shown in FIG. 3C. For example, in the embodiments of FIGS. 3A through 3C, the pair of expandable metal features 310 (FIGS. 3A and 3B) and pair of expanded metal features 350 (FIG. 3C) are positioned axially between the pair of metal backup shoes 230 and the one or more elastomeric sealing elements 220. Otherwise, the process for setting the one or more elastomeric sealing elements 220, and subjecting the pair of expandable metal features 310 to reactive fluid to form the pair of expanded metal features 350, may be the same as that discussed above.

Figure 4A:
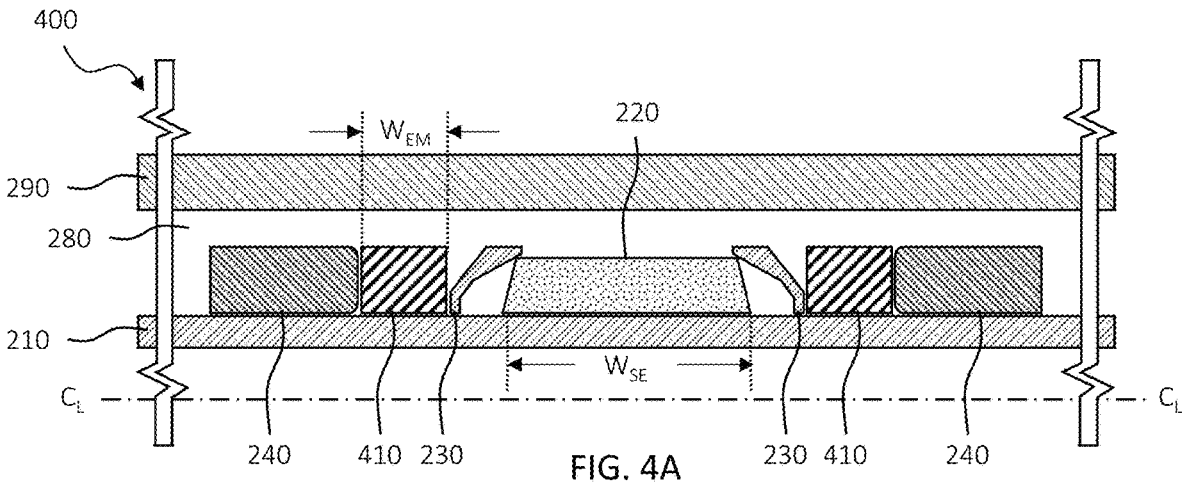
Figure 4B:
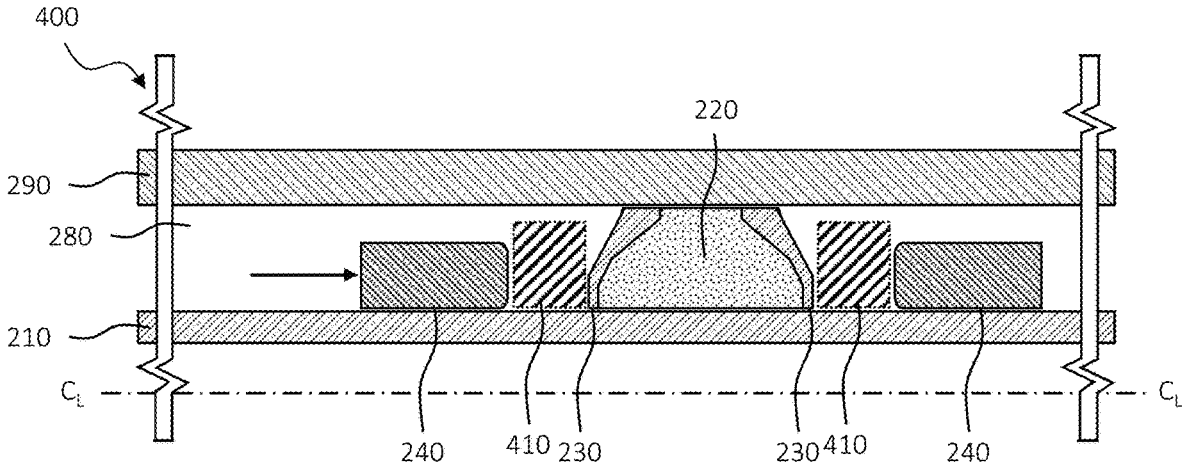
Figure 4B:
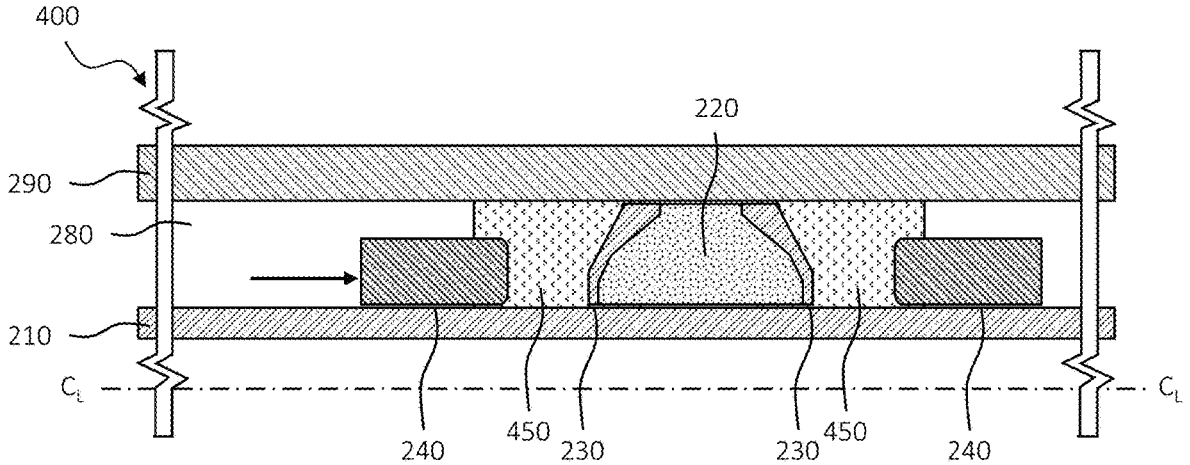

Turning to FIGS. 4A through 4C, depicted are various different deployment states for a sealing assembly 400 designed, manufactured and operated according to an alternative embodiment of the disclosure. FIG. 4A illustrates the sealing tool 400 in a run-in-hole state, and thus its elastomeric sealing element is in the radially relaxed state and its expandable metal features pre-expansion. In contrast, FIG. 4B illustrates the sealing tool 400 with its elastomeric element in the radially expanded state, but its expandable metal features remain pre-expansion. In contrast, FIG. 4C illustrates the sealing tool 400 with its elastomeric element in the radially expanded state and including expanded metal features (e.g., the expandable metal features post-expansion). As disclosed above, the expandable metal may be subjected to a suitable reactive fluid within the wellbore, thereby forming the expanded metal features.

The sealing assembly 400 of FIGS. 4A through 4C is similar in many respects to the sealing assembly 300 of FIGS. 3A through 3C. Accordingly, like reference numbers have been used to illustrate similar, if not identical, features. The sealing assembly 400 differs, for the most part, from the sealing assembly 300, in that the sealing assembly 400 does not employ a separate pair of expandable metal features 310 straddling the one or more elastomeric sealing elements 220, but includes a separate pair of expandable metal features 410 straddling the pair of metal backup shoes 230, as shown in FIGS. 4A and 4B, and a separate pair of expanded metal features 450 straddling the pair of metal backup shoes 230, as shown in FIG. 4C. For example, in the embodiments of FIGS. 4A through 4C, the pair of metal backup shoes 230 are positioned axially between the pair of expandable metal features 410 (FIGS. 4A and 4B), and pair of expanded metal features 450 (FIG. 3C). Otherwise, the process for setting the one or more elastomeric sealing elements 220, and subjecting the pair of expandable metal features 410 to reactive fluid to form the pair of expanded metal features 450, may be the same as that discussed above.

Figure 5A:
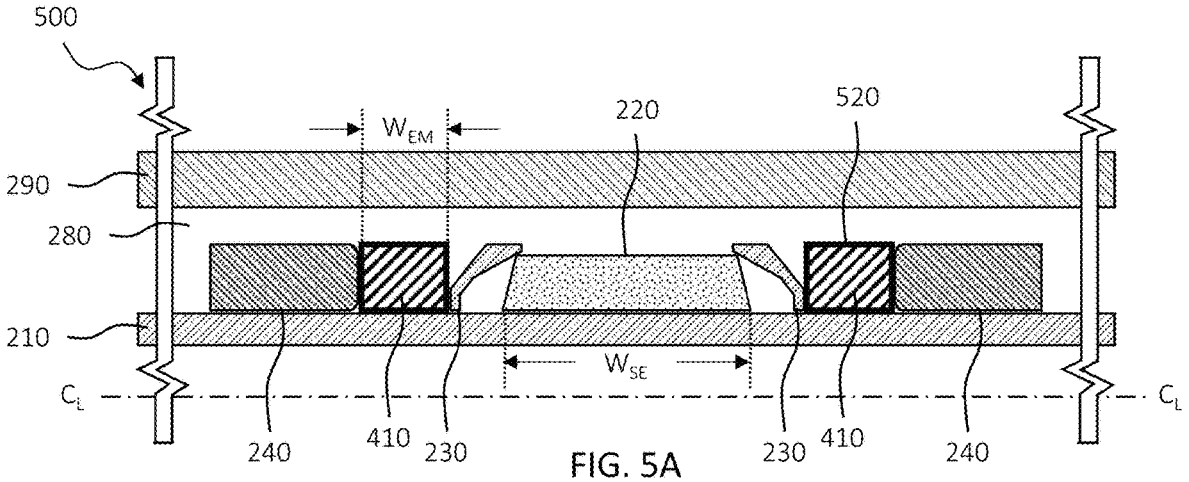
FIGS. 5A through 5C illustrate various different deployment states for a sealing tool designed, manufactured and operated according to an alternative embodiment of the disclosure.
Figure 5B:
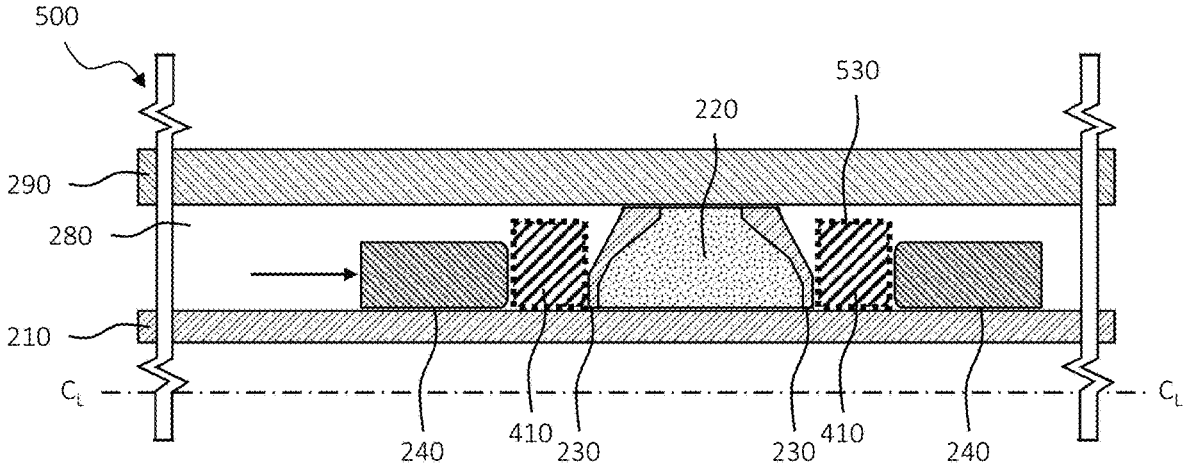
Figure 5C:
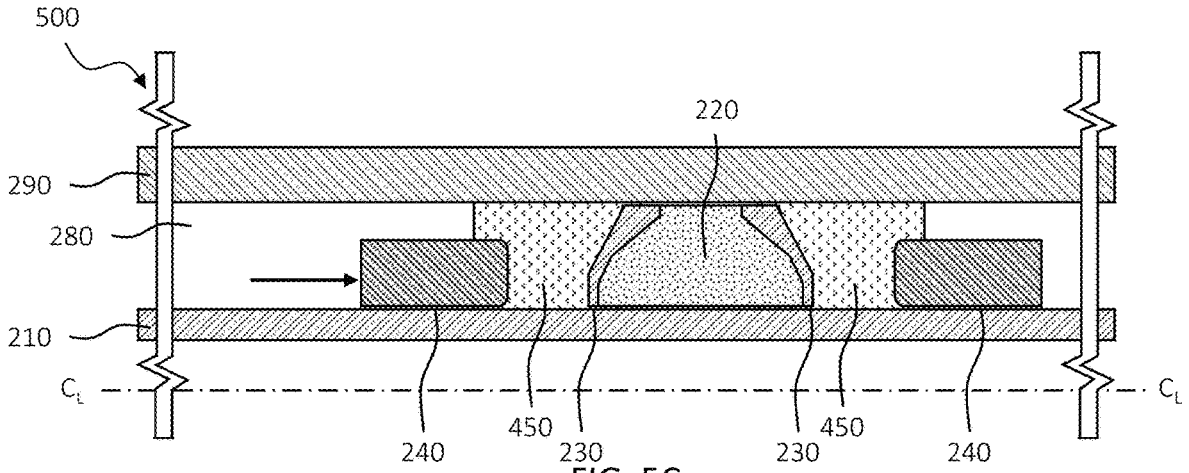

Turning to FIGS. 5A through 5C, depicted are various different deployment states for a sealing assembly 500 designed, manufactured and operated according to an alternative embodiment of the disclosure. FIG. 5A illustrates the sealing tool 500 in a run-in-hole state, and thus its elastomeric sealing element is in the radially relaxed state and its expandable metal features pre-expansion. In contrast, FIG. 5B illustrates the sealing tool 500 with its elastomeric element in the radially expanded state, but its expandable metal features remain pre-expansion. In contrast, FIG. 5C illustrates the sealing tool 500 with its elastomeric element in the radially expanded state and including expanded metal features (e.g., the expandable metal features post-expansion). As disclosed above, the expandable metal may be subjected to a suitable reactive fluid within the wellbore, thereby forming the expanded metal features.

The sealing assembly 500 of FIGS. 5A through 5C is similar in many respects to the sealing assembly 400 of FIGS. 4A through 4C. Accordingly, like reference numbers have been used to illustrate similar, if not identical, features. The sealing assembly 500 differs, for the most part, from the sealing assembly 400, in that the sealing assembly 500 includes a delay coating 510 enclosing one or more of the pair of expandable metal features 410, as shown in FIG. 5A. Those skilled in the art understand the purpose for the delay coating, including to delay the reaction of the expandable metal features 410 with the reactive fluid for a given period of time.

In certain instances, the delay coating is a porous material that over time allows the reactive fluid to penetrate therethrough and thereby form the expanded metal features 450. In other embodiments, such as that shown in FIG. 5A, the delay coating is a non-porous material, and thus will fully protect the pair of expandable metal features 410 so long as it remains intact. In accordance with the embodiment of FIG. 5B, the delay coating 510 may be broken during the process for setting the one or more elastomeric sealing elements 220. The delay coating 510 can be an epoxy, a polymer, a metal, a ceramic, or a glass, among others. In one embodiment, the pair of expandable metal features 410 are encapsulated in a nickel delay coating. In this embodiment, the process for setting the one or more elastomeric sealing elements 220 stretches the nickel delay coating. The stretching causes tears in the nickel delay coating, which triggers the hydration in the pair of expandable metal features 410, thereby resulting in the expanded metal features 450. Otherwise, the process for setting the one or more elastomeric sealing elements 220, and subjecting the pair of expandable metal features 410 to reactive fluid to form the pair of expanded metal features 450, may be the same as that discussed above.

Figure 6A:
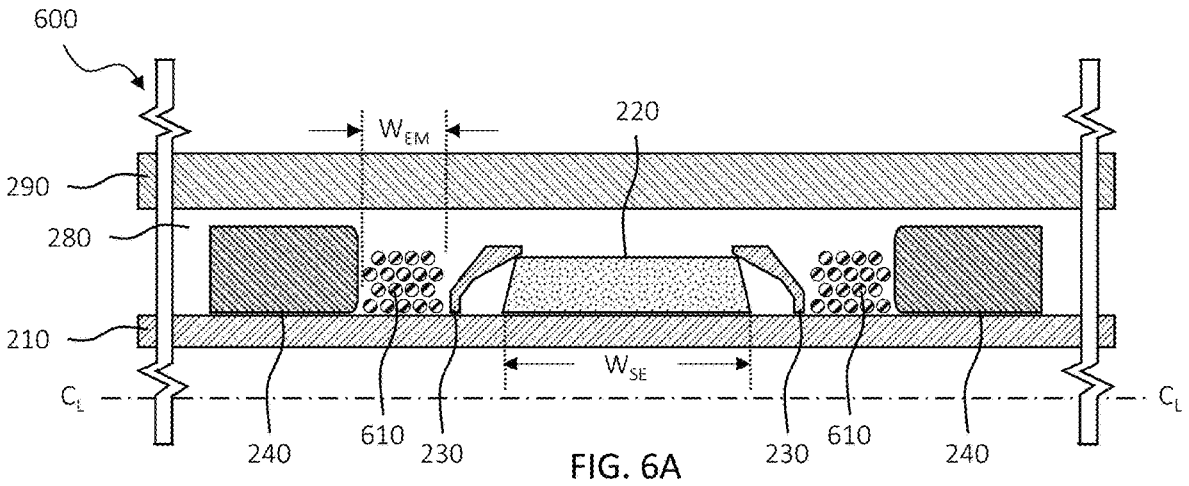
FIGS. 6A through 6C illustrate various different deployment states for a sealing tool designed, manufactured and operated according to an alternative embodiment of the disclosure.
Figure 6B:
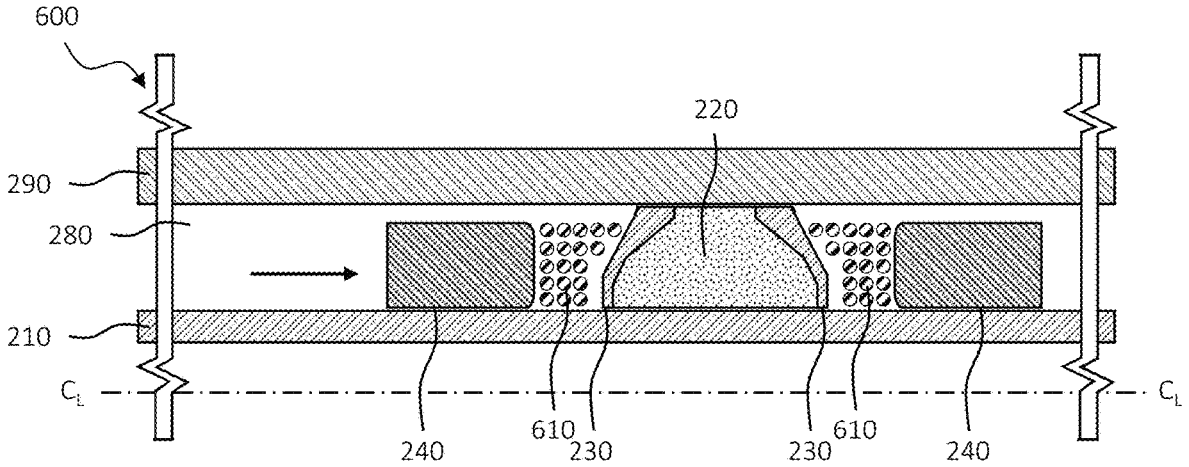
Figure 6C:
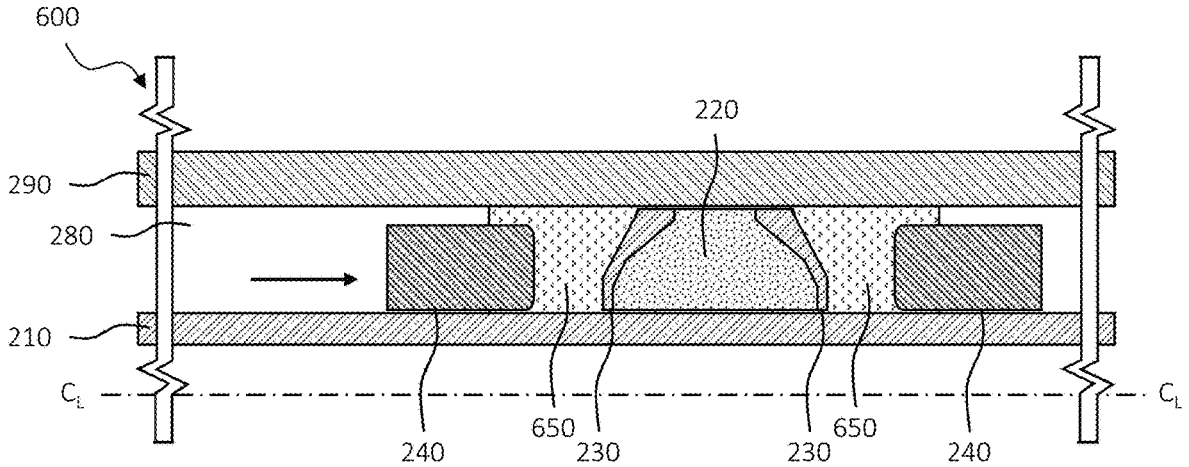

Turning to FIGS. 6A through 6C, depicted are various different deployment states for a sealing assembly 600 designed, manufactured and operated according to an alternative embodiment of the disclosure. FIG. 6A illustrates the sealing tool 600 in a run-in-hole state, and thus its elastomeric sealing element is in the radially relaxed state and its expandable metal features pre-expansion. In contrast, FIG. 6B illustrates the sealing tool 600 with its elastomeric element in the radially expanded state, but its expandable metal features remain pre-expansion. In contrast, FIG. 6C illustrates the sealing tool 600 with its elastomeric element in the radially expanded state and including expanded metal features (e.g., the expandable metal features post-expansion). As disclosed above, the expandable metal may be subjected to a suitable reactive fluid within the wellbore, thereby forming the expanded metal features.

The sealing assembly 600 of FIGS. 6A through 6C is similar in many respects to the sealing assembly 400 of FIGS. 4A through 4C. Accordingly, like reference numbers have been used to illustrate similar, if not identical, features. The sealing assembly 600 differs, for the most part, from the sealing assembly 400, in that each of the pair of expandable metal features 610 is a wire of expandable metal wrapped multiple (e.g., ten or more times) around the mandrel 210. The wire of expandable metal, in at least one embodiment, could have a diameter ranging from 2 mm to 6 mm, thereby providing an increased surface area for the hydrolysis reaction. As is illustrated in FIG. 6C, a pair of expanded metal features 650 would result from the hydrolysis reaction. Otherwise, the process for setting the one or more elastomeric sealing elements 220, and subjecting the pair of expandable metal features 610 to reactive fluid to form the pair of expanded metal features 650, may be the same as that discussed above.

Figure 7A:
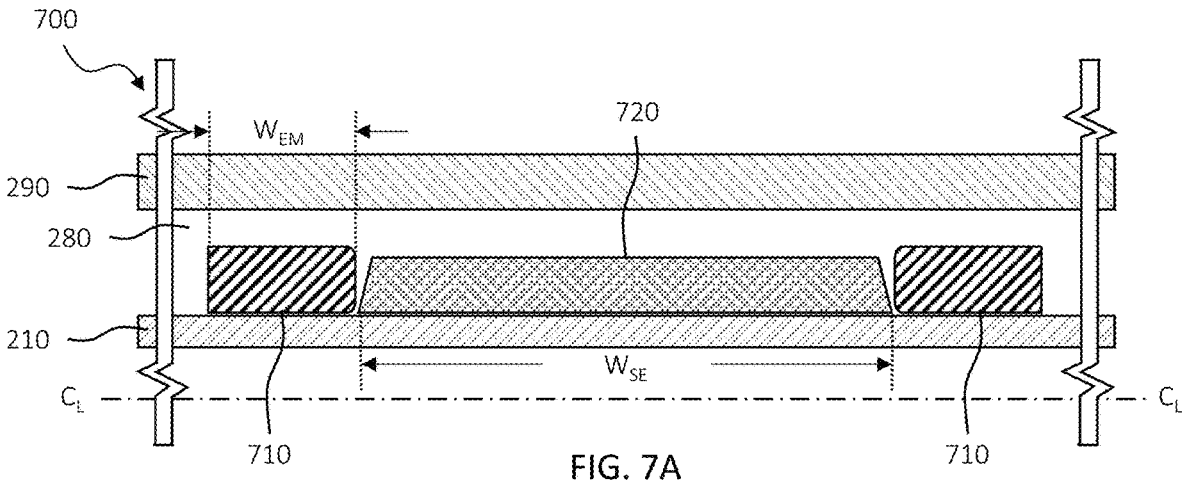
FIGS. 7A through 7C illustrate various different deployment states for a sealing tool designed, manufactured and operated according to an alternative embodiment of the disclosure.
Figure 7B:
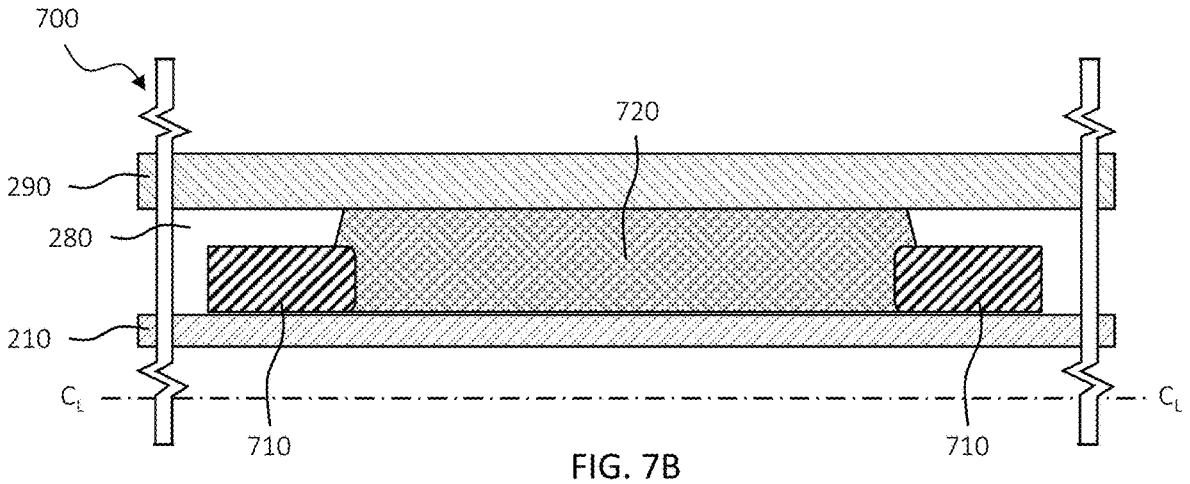
Figure 7C:
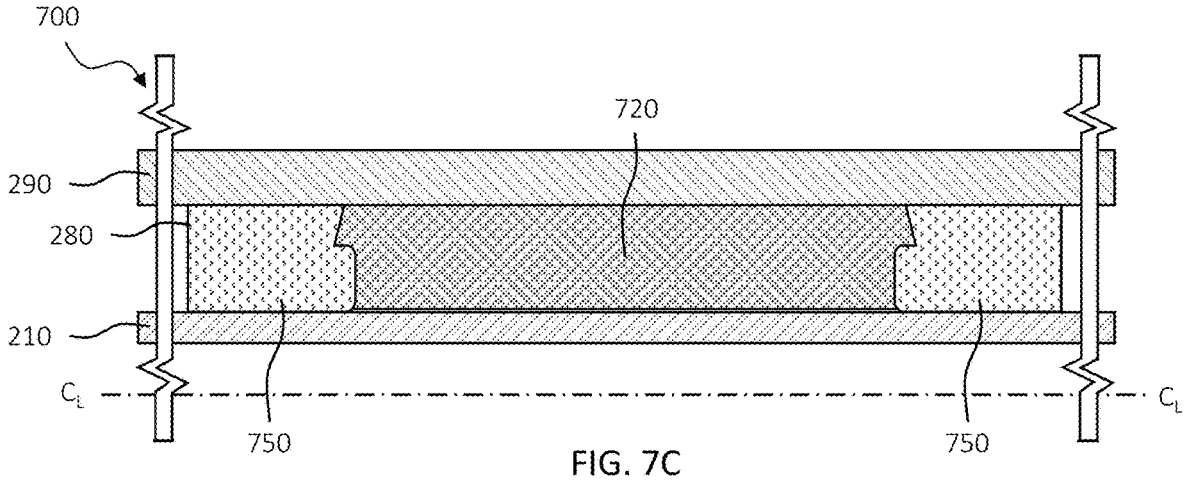

Turning to FIGS. 7A through 7C, depicted are various different deployment states for a sealing assembly 700 designed, manufactured and operated according to an alternative embodiment of the disclosure. FIG. 7A illustrates the sealing tool 700 in a run-in-hole state, and thus its elastomeric sealing element is in the radially relaxed state and its expandable metal features pre-expansion. In contrast, FIG. 7B illustrates the sealing tool 700 with its elastomeric element in the radially expanded state, but its expandable metal features remain pre-expansion. In contrast, FIG. 7C illustrates the sealing tool 700 with its elastomeric element in the radially expanded state and including expanded metal features (e.g., the expandable metal features post-expansion). As disclosed above, the expandable metal may be subjected to a suitable reactive fluid within the wellbore, thereby forming the expanded metal features.

The sealing assembly 700 of FIGS. 7A through 7C is similar in certain respects to the sealing assembly 200 of FIGS. 2A through 2C. Accordingly, like reference numbers have been used to illustrate similar, if not identical, features. The sealing assembly 700 differs, for the most part, from the sealing assembly 200, in that the sealing assembly 700 employs one or more swellable elastomeric sealing elements 720. Thus, in the embodiment of FIGS. 7A through 7C, the one or more swellable elastomeric sealing elements 720 are configured to swell to move between the radially relaxed state and the radially expanded state, as opposed to employing the axially sliding end rings to expand the one or more elastomeric sealing elements 220.

Further to the embodiment of FIGS. 7A through 7C, a pair of expandable metal end rings 710 are employed. In at least one embodiment, the pair of expandable metal end rings 710 comprise a metal configured to expand in response to hydrolysis. The pair of expandable metal end rings 710, in the embodiment of FIGS. 7A through 7C, are axially fixed relative to one another. In yet other embodiments, however, the pair of expandable metal end rings 710 are configured to axially slide relative to one another. Otherwise, the process for setting the one or more elastomeric sealing elements 720, and subjecting the pair of expandable metal end rings 710 to reactive fluid to form the pair of expanded metal features 450, may be the same as that discussed above.

Aspects disclosed herein include:

A. A sealing tool, the sealing tool including: 1) a mandrel; and 2) a sealing assembly positioned about the mandrel, the sealing assembly including: a) one or more elastomeric sealing elements having a pre-expansion width ($W_{SE}$), the one or more elastomeric sealing elements operable to move between a radially relaxed state and a radially expanded state; and b) a pair of expandable metal features straddling the one or more elastomeric sealing elements, each of the pair of expandable metal features comprising a metal configured to expand in response to hydrolysis and having a pre-expansion width ($W_{EM}$), and further wherein the pre-expansion width ($W_{SE}$) is at least three times the pre-expansion width ($W_{EM}$).

B. A method for sealing an annulus within a wellbore, the method including: 1) providing a sealing tool within a wellbore, the sealing tool including: a) a mandrel; and b) a sealing assembly positioned about the mandrel, the sealing assembly including: i) one or more elastomeric sealing elements having a pre-expansion width ($W_{SE}$), the one or more elastomeric sealing elements operable to move between a radially relaxed state and a radially expanded state; and ii) a pair of expandable metal features straddling the one or more elastomeric sealing elements, each of the pair of expandable metal features comprising a metal configured to expand in response to hydrolysis and having a pre-expansion width ($W_{EM}$), and further wherein the pre-expansion width ($W_{SE}$) is at least three times the pre-expansion width ($W_{EM}$); 2) setting the one or more elastomeric sealing elements by moving the one or more elastomeric elements from the radially relaxed state to the radially expanded state; and 3) subjecting the pair of expandable metal features to reactive fluid to form a pair of expanded metal features.

C. A well system, the well system including: 1) a wellbore extending through one or more subterranean formations; and 2) a sealing tool positioned within the wellbore, the sealing tool including: a) a mandrel; and b) a sealing assembly positioned about the mandrel, the sealing assembly including: i) one or more elastomeric sealing elements having a pre-expansion width ($W_{SE}$), the one or more elastomeric sealing elements in a radially expanded state; and ii) a pair of expanded metal features straddling the one or more elastomeric sealing elements, each of the pair of expanded metal features comprising a metal that has expanded in response to hydrolysis.

Aspects A, B, and C may have one or more of the following additional elements in combination: Element 1: wherein the pair of expandable metal features are a pair of expandable metal backup shoes. Element 2: further including a pair of metal backup shoes straddling the one or more elastomeric sealing elements. Element 3: wherein the pair of expandable metal features are positioned axially between the pair of metal backup shoes and the one or more elastomeric sealing elements. Element 4: wherein the pair of metal backup shoes are positioned axially between the pair of expandable metal features and the one or more elastomeric sealing elements. Element 5: further including a pair of end rings straddling the pair of expandable metal features, the pair of end rings configured to axially slide relative to one another to move the elastomeric sealing elements between the radially relaxed state and the radially expanded state. Element 6: wherein the pair of expandable metal features are a pair of end rings straddling the one or more elastomeric sealing elements, the pair of end rings axially fixed relative to one another. Element 7: wherein the one or more elastomeric sealing elements are one or more swellable elastomeric sealing elements configured to swell to move between the radially relaxed state and the radially expanded state. Element 8: further including a delay coating enclosing each of the pair of expandable metal features. Element 9: wherein each of the pair of expandable metal features are a wire of expandable metal wrapped multiple times around the mandrel. Element 10: wherein the setting occurs prior to the subjecting. Element 11: wherein the setting includes radially moving the pair of expandable metal features relative to one another, the radially moving mechanically deforming the pair of expandable metal features, and further wherein subjecting the pair of expandable metal features to the reactive fluid includes subjecting the deformed pair of expandable metal features to the reactive fluid to form the pair of expanded metal features. Element 12: further including a pair of end rings straddling the pair of expandable metal features, wherein the pair of expandable metal features are a pair of expandable metal backup shoes, and further wherein setting the one or more elastomeric elements includes axially sliding the pair of end rings relative to each other to move the one or more elastomeric elements from the radially relaxed state to the radially expanded state. Element 13: further including a pair of metal backup shoes straddling the one or more elastomeric elements, the pair of expandable metal features positioned axially between the pair of metal backup shoes and the one or more elastomeric sealing elements, and further including a pair of end rings straddling the pair of metal backup shoes, and wherein setting the one or more elastomeric elements includes axially sliding the pair of end rings relative to each other to move the one or more elastomeric elements from the radially relaxed state to the radially expanded state. Element 14: further including a pair of metal backup shoes straddling the one or more elastomeric elements, the pair of metal backup shoes positioned axially between the pair of expandable metal features and the one or more elastomeric sealing elements, and further including a pair of end rings straddling the pair of expandable metal features, and wherein setting the one or more elastomeric elements includes axially sliding the pair of end rings relative to each other to move the one or more elastomeric elements from the radially relaxed state to the radially expanded state. Element 15: wherein the pair of expandable metal features are a pair of end rings straddling the one or more elastomeric sealing elements, the pair of end rings axially fixed relative to one another, and wherein setting the one or more elastomeric elements includes subjecting the one or more elastomeric elements to an activation fluid causing the one or more elastomeric elements to swell and move between the radially relaxed state and the radially expanded state. Element 16: further including a delay coating enclosing each of the pair of expandable metal features, and further wherein setting the one or more elastomeric elements breaks the delay coating thereby allowing the reactive fluid to form the pair of expanded metal features. Element 17: wherein each of the pair of expandable metal features are a wire of expandable metal wrapped multiple times around the mandrel.

Those skilled in the art to which this application relates will appreciate that other and further additions, deletions, substitutions and modifications may be made to the described embodiments.

What is claimed is:

1. A sealing tool, comprising:

a mandrel; and a sealing assembly positioned about the mandrel, the sealing assembly including:

one or more elastomeric sealing elements having a pre-expansion width ($W_{SE}$), the one or more elastomeric sealing elements operable to move between a radially relaxed state and a radially expanded state; and a pair of non-elastomeric conductive expandable metal features straddling the one or more elastomeric sealing elements, each of the pair of expandable metal features comprising a metal configured to expand in response to hydrolysis and having a pre-expansion width ($W_{EM}$), and further wherein the pre-expansion width ($W_{SE}$) is at least three times the pre-expansion width ($W_{EM}$), wherein a volume of the pair of non-elastomeric expandable metal features is bound, such that during expansion, the expandable metal is configured to go from metal to micron-scale particles that are larger and lock together.

2. The sealing tool as recited in claim 1, wherein the pair of expandable metal features are a pair of expandable metal backup shoes.

3. The sealing tool as recited in claim 1, further including a pair of metal backup shoes straddling the one or more elastomeric sealing elements.

4. The sealing tool as recited in claim 3, wherein the pair of expandable metal features are positioned axially between the pair of metal backup shoes and the one or more elastomeric sealing elements.

5. The sealing tool as recited in claim 3, wherein the pair of metal backup shoes are positioned axially between the pair of expandable metal features and the one or more elastomeric sealing elements.

6. The sealing tool as recited in claim 1, further including a pair of end rings straddling the pair of expandable metal features, the pair of end rings configured to axially slide relative to one another to move the one or more elastomeric sealing elements between the radially relaxed state and the radially expanded state.

7. The sealing tool as recited in claim 1, wherein the pair of expandable metal features are a pair of end rings straddling the one or more elastomeric sealing elements, the pair of end rings axially fixed relative to one another.

8. The sealing tool as recited in claim 7, wherein the one or more elastomeric sealing elements are one or more swellable elastomeric sealing elements configured to swell to move between the radially relaxed state and the radially expanded state.

9. The sealing tool as recited in claim 1, further including a delay coating enclosing each of the pair of expandable metal features.

10. The sealing tool as recited in claim 1, wherein each of the pair of expandable metal features are a wire of expandable metal wrapped multiple times around the mandrel.

11. A method for sealing an annulus within a wellbore, comprising:

providing a sealing tool within a wellbore, the sealing tool including:

a mandrel; and a sealing assembly positioned about the mandrel, the sealing assembly including:

one or more elastomeric sealing elements having a pre-expansion width ($W_{SE}$), the one or more elastomeric sealing elements operable to move between a radially relaxed state and a radially expanded state; and a pair of non-elastomeric conductive expandable metal features straddling the one or more elastomeric sealing elements, each of the pair of expandable metal features comprising a metal configured to expand in response to hydrolysis and having a pre-expansion width ($W_{EM}$), and further wherein the pre-expansion width ($W_{SE}$) is at least three times the pre-expansion width ($W_{EM}$), wherein a volume of the pair of non-elastomeric expandable metal features is bound, such that during expansion, the expandable metal is configured to go from metal to micron-scale particles that are larger and lock together;

setting the one or more elastomeric sealing elements by moving the one or more elastomeric elements from the radially relaxed state to the radially expanded state; and subjecting the pair of expandable metal features to reactive fluid to form a pair of expanded metal features.

12. The method as recited in claim 11, wherein the setting occurs prior to the subjecting.

13. The method as recited in claim 12, wherein the setting includes radially moving the pair of expandable metal features relative to one another, the radially moving mechanically deforming the pair of expandable metal features, and further wherein subjecting the pair of expandable metal features to the reactive fluid includes subjecting the deformed pair of expandable metal features to the reactive fluid to form the pair of expanded metal features.

14. The method as recited in claim 11, further including a pair of end rings straddling the pair of expandable metal features, wherein the pair of expandable metal features are a pair of expandable metal backup shoes, and further wherein setting the one or more elastomeric elements includes axially sliding the pair of end rings relative to each other to move the one or more elastomeric elements from the radially relaxed state to the radially expanded state.

15. The method as recited in claim 11, further including a pair of metal backup shoes straddling the one or more elastomeric elements, the pair of expandable metal features positioned axially between the pair of metal backup shoes and the one or more elastomeric sealing elements, and further including a pair of end rings straddling the pair of metal backup shoes, and wherein setting the one or more elastomeric elements includes axially sliding the pair of end rings relative to each other to move the one or more elastomeric elements from the radially relaxed state to the radially expanded state.

16. The method as recited in claim 11, further including a pair of metal backup shoes straddling the one or more elastomeric elements, the pair of metal backup shoes positioned axially between the pair of expandable metal features and the one or more elastomeric sealing elements, and further including a pair of end rings straddling the pair of expandable metal features, and wherein setting the one or more elastomeric elements includes axially sliding the pair of end rings relative to each other to move the one or more elastomeric elements from the radially relaxed state to the radially expanded state.

17. The method as recited in claim 11, wherein the pair of expandable metal features are a pair of end rings straddling the one or more elastomeric sealing elements, the pair of end rings axially fixed relative to one another, and wherein setting the one or more elastomeric elements includes subjecting the one or more elastomeric elements to an activation fluid causing the one or more elastomeric elements to swell and move between the radially relaxed state and the radially expanded state.

18. The method as recited in claim 11, further including a delay coating enclosing each of the pair of expandable metal features, and further wherein setting the one or more elastomeric elements breaks the delay coating thereby allowing the reactive fluid to form the pair of expanded metal features.

19. The method as recited in claim 11, wherein each of the pair of expandable metal features are a wire of expandable metal wrapped multiple times around the mandrel.

20. A well system, comprising:

a wellbore extending through one or more subterranean formations; and a sealing tool positioned within the wellbore, the sealing tool including:

a mandrel; and a sealing assembly positioned about the mandrel, the sealing assembly including:

one or more elastomeric sealing elements having a pre-expansion width ($W_{SE}$), the one or more elastomeric sealing elements in a radially expanded state; and a pair of volumetrically bound expanded metal features straddling the one or more elastomeric sealing elements, each of the pair of expanded metal features comprising a metal that has expanded in response to hydrolysis, and thus comprising micron-scale particles that lock together.

* * * * *